US008560158B2

(12) United States Patent
Wang et al.

(10) Patent No.: US 8,560,158 B2
(45) Date of Patent: Oct. 15, 2013

(54) METHOD AND APPARATUS FOR ENGINE CONTROL MODULE WAKE-UP TEST

(75) Inventors: Wenbo Wang, Novi, MI (US); William R. Cadman, Fenton, MI (US); Robert Jackson, Brighton, MI (US); Paul William Rasmussen, Milford, MI (US)

(73) Assignee: GM Global Technology Operations LLC

( * ) Notice: Subject to any disclaimer, the term of this patent is extended or adjusted under 35 U.S.C. 154(b) by 364 days.

(21) Appl. No.: 12/854,427

(22) Filed: Aug. 11, 2010

(65) Prior Publication Data

US 2012/0041631 A1 Feb. 16, 2012

(51) Int. Cl.
*F02M 33/02* (2006.01)

(52) U.S. Cl.
USPC ..... 701/29; 701/29.1; 701/34.4

(58) Field of Classification Search
USPC ..... 701/29, 29.1, 34.4
See application file for complete search history.

(56) References Cited

U.S. PATENT DOCUMENTS

2009/0271079 A1* 10/2009 Kobayashi et al. ..... 701/51
2009/0277427 A1* 11/2009 Yoshimura ..... 123/520

* cited by examiner

*Primary Examiner* — Mary Cheung
*Assistant Examiner* — Yuen Wong

(57) ABSTRACT

A fuel system diagnostic wakeup system for a vehicle includes a first control module. The first control module generates a wakeup request, powers off when the vehicle powers off, and powers on and performs a fuel system diagnostic in response to a wakeup signal while the vehicle is powered off. A second control module independent of the first control module receives the wakeup request and generates the wakeup signal after the vehicle powers off based on the wakeup request.

18 Claims, 6 Drawing Sheets

400
402
START
404
Reset Wakeup Clock
406
Wakeup Needed?
Y
408
Wakeup Clock Set?
Y
412
Run Wakeup Diagnostic
N
414
Wakeup Request Set?
N
418
Wakeup Clock Inactive or Expired?
N
428
Wakeup Request Cancel
Y
Y
416
Wakeup Clock Status Active?
426
Wakeup Request Set
432
Reset Time T
Y
N
Wakeup Request = No Action
420
Calculate Time T Until Wakeup
422
Y
430
Wakeup Clock Set Complete
424
Timeout?
N
410
END

METHOD AND APPARATUS FOR ENGINE CONTROL MODULE WAKE-UP TEST

FIELD

The present disclosure relates to vehicle fuel system diagnostics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust a mixture of air and fuel to generate torque. The fuel of the air/fuel mixture may be a combination of liquid fuel and vapor fuel. A fuel system is used to supply liquid fuel and vapor fuel to the engine. A fuel injector provides the engine with liquid fuel drawn from a fuel tank. The fuel system may include a purging system that provides the engine with fuel vapor drawn from a canister.

Generally, liquid fuel is contained within the fuel tank. In some circumstances, the liquid fuel may vaporize and form fuel vapor. The canister stores the fuel vapor. The purge system includes a purge valve and a vent valve. Operation of the engine causes a vacuum (low pressure relative to atmospheric pressure) to form within an intake manifold of the engine. The vacuum within the intake manifold and selective actuation of the purge and vent valves allows the fuel vapor to be drawn into the intake manifold, thereby purging the fuel vapor from the vapor canister.

SUMMARY

A fuel system diagnostic wakeup system for a vehicle includes a first control module. The first control module generates a wakeup request, powers off when the vehicle powers off, and powers on and performs a fuel system diagnostic in response to a wakeup signal while the vehicle is powered off. A second control module independent of the first control module receives the wakeup request and generates the wakeup signal after the vehicle powers off based on the wakeup request.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
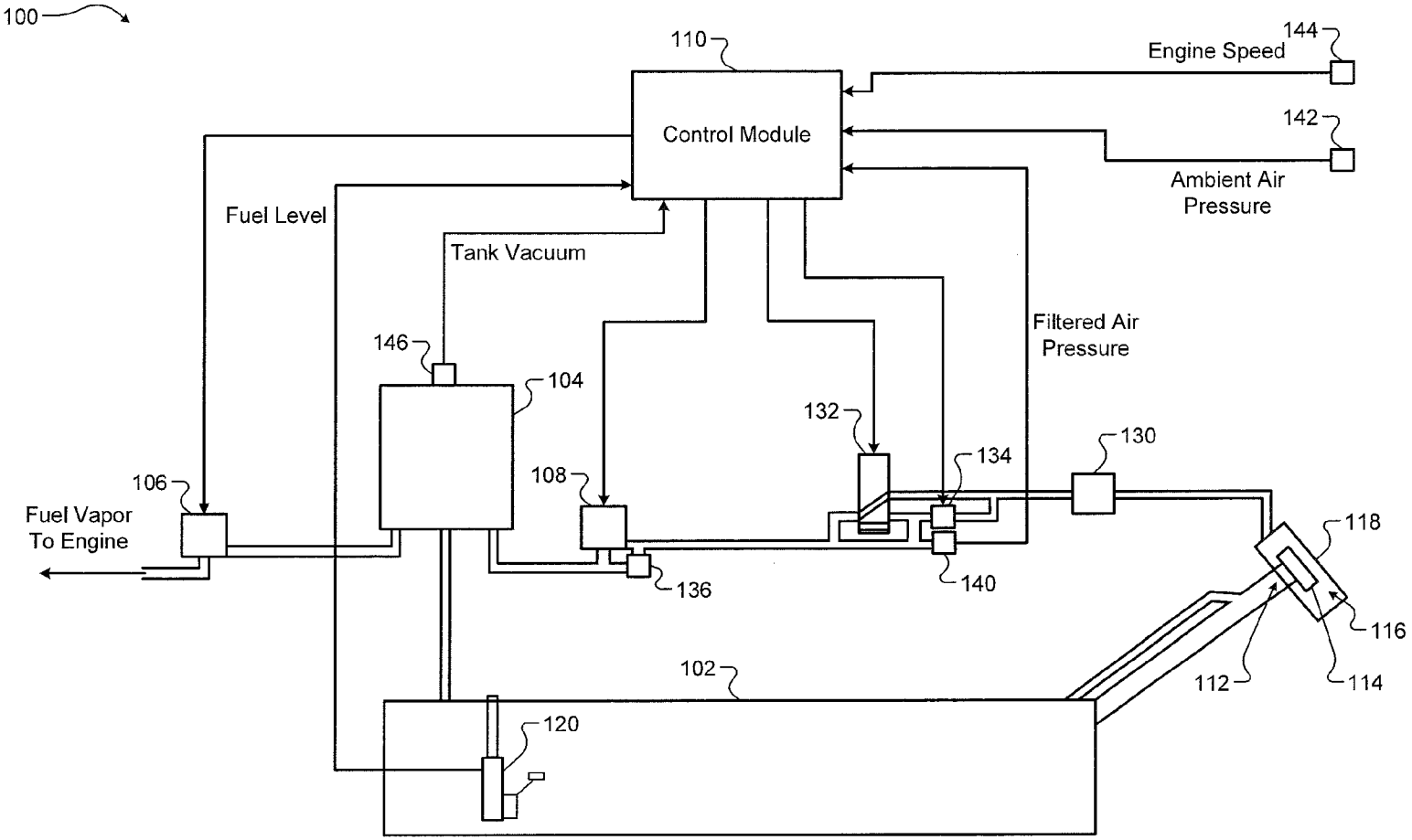
FIG. 1 is a functional block diagram of a fuel system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a functional block diagram of an exemplary fuel system 100 is presented. A vehicle includes an internal combustion engine (not shown) that generates drive torque. For example only, the engine may be a gasoline-type engine, a diesel-type engine, and/or another suitable type of engine. The engine combusts a mixture of air and fuel within one or more cylinders of the engine to generate torque.

In some vehicles, torque generated by the engine may be used to propel the vehicle. In such vehicles, torque output by the engine may be transferred to a transmission (not shown), and the transmission may transfer torque to one or more wheels of the vehicle.

In other vehicles, such as parallel-hybrid vehicles, torque output by the engine may not be transferred to the transmission. Instead, torque output by the engine may be converted into electrical energy by, for example, a motor-generator or a belt alternator starter (BAS). The electrical energy may be provided to the motor-generator, to another motor-generator, to an electric motor, and/or to an energy storage device. The electrical energy may be used to generate torque to propel the vehicle. Some hybrid vehicles may also receive electrical energy from an alternating current (AC) power source, such as a standard wall outlet. Such hybrid vehicles may be referred to as plug-in hybrid vehicles.

The fuel system 100 supplies fuel to the engine, such as an engine of a plug-in hybrid vehicle. More specifically, the fuel system 100 supplies liquid fuel and fuel vapor to the engine. While the fuel system 100 may be discussed as it relates to a plug-in hybrid vehicle, the present disclosure is also applicable to other types of vehicles having an internal combustion engine.

The fuel system 100 includes a fuel tank 102 that contains liquid fuel. Liquid fuel is drawn from the fuel tank 102 by one or more fuel pumps (not shown) and is supplied to the engine.

Some conditions, such as heat, vibration, and radiation, may cause liquid fuel within the fuel tank 102 to vaporize. A canister 104 traps and stores vaporized fuel (i.e., fuel vapor). For example only, the canister 104 may include one or more substances that store fuel vapor, such as charcoal.

Operation of the engine creates a vacuum within an intake manifold (not shown) of the engine. A purge valve 106 and a vent valve 108 may be selectively operated (e.g., opened and closed) to draw fuel vapor from the canister 104 to the intake manifold for combustion. More specifically, operation of the purge valve 106 and the vent valve 108 may be coordinated to purge fuel vapor from the canister 104. A control module (CM) 110, such as an engine control module (ECM) controls the operation of the purge valve 106 and the vent valve 108 to control the provision of fuel vapor to the engine.

At a given time, the purge valve 106 and the vent valve 108 may each be in one of two positions: an open position or a closed position. The CM 110 may enable the provision of ambient air to the canister 104 by actuating the vent valve 108 to the open position. While the vent valve 108 is in the open position, the CM 110 may selectively command the purge valve 106 to the open position to purge fuel vapor from the canister 104 to the intake manifold. The CM 110 may control the rate at which fuel vapor is purged from the canister 104 (i.e., a purge rate). For example only, the purge valve 106 may include a solenoid valve, and the CM 110 may control the purge rate by controlling duty cycle of a signal applied to the purge valve 106.

The vacuum within the intake manifold draws fuel vapor from the canister 104 through the purge valve 106 to the intake manifold. The purge rate may be determined based on the duty cycle of the signal applied to the purge valve 106 and the amount of fuel vapor within the canister 104. Ambient air is drawn into the canister 104 through the open vent valve 108 as fuel vapor is drawn from the canister 104. The vent valve 108 may also be referred to as a diurnal valve.

The CM 110 actuates the vent valve 108 to the open position and controls the duty cycle of the purge valve 106 during operation of the engine. When the engine is shut down and not running (e.g., key OFF), the CM 110 actuates the purge valve 106 and the vent valve 108 to their respective closed positions. In this manner, the purge valve 106 and the vent valve 108 are generally maintained in their respective closed positions when the engine is not running.

A driver of the vehicle may add liquid fuel to the fuel tank 102. Liquid fuel may be added to the fuel tank 102 via a fuel inlet 112. A fuel cap 114 closes the fuel inlet 112. The fuel cap 114 and the fuel inlet 112 may be accessed via a fueling compartment 116. A fuel door 118 closes to shield and close the fueling compartment 116.

A fuel level sensor 120 measures the amount of liquid fuel within the fuel tank 102 and generates a fuel level signal based on the amount of liquid fuel within the fuel tank 102. For example only, the amount of liquid fuel in the fuel tank 102 may be expressed in terms of a volume, a percentage of a maximum volume of the fuel tank 102, or another suitable measure of the amount of fuel in the fuel tank 102.

The ambient air provided to the canister 104 through the vent valve 108 may be drawn from the fueling compartment 116. A filter 130 receives the ambient air and filters various particulate from the ambient air. For example only, the filter 130 may filter particulate having a dimension of more than a predetermined dimension, such as greater than approximately 5 microns. Filtered air is provided to the vent valve 108.

A switching valve 132 may be implemented to enable and disable the provision of the filtered air to the vent valve 108. The switching valve 132 may be actuated to a first position, shown in the exemplary embodiment of FIG. 1, to provide the filtered air via a first air path. When the filtered air is provided to the vent valve 108 via the first air path, the filtered air may be provided from the filter 130.

The switching valve 132 may also be selectively actuated to a second position to draw air through the vent valve 108 via a second air path. A vacuum pump 134 may draw the air through the vent valve 108 and expel the air through the filter 130. The vacuum pump 134 may be used, for example, in conjunction with leak diagnostics of the purge valve 106 and/or the vent valve 108. A relief valve 136 may also be implemented and may selectively discharge the pressure or vacuum. The CM 110 may control the switching valve 132 and the vacuum pump 134.

A filtered air pressure sensor 140 measures pressure of the filtered air at a location between the filter 130 and the vent valve 108. The filtered air pressure sensor 140 generates a filtered air pressure signal based on the filtered air pressure. The filtered air pressure sensor 140 provides the filtered air pressure to the CM 110.

The CM 110 may also receive signals from other sensors, such as an ambient pressure sensor 142, an engine speed sensor 144, and a tank vacuum sensor 146. The ambient pressure sensor 142 measures pressure of the ambient air and generates an ambient air pressure signal based on the ambient air pressure.

The engine speed sensor 144 measures rotational speed of the engine and generates an engine speed signal based on the rotational speed. For example only, the engine speed sensor 144 may measure the rotational speed based on rotation of a crankshaft of the engine. The tank vacuum sensor 146 measures vacuum of the fuel tank 102 and generates a tank vacuum signal based on the tank vacuum. For example only, the tank vacuum sensor 146 may measure the tank vacuum within the canister 104. In other implementations, tank pressure may be measured, and the tank vacuum may be determined based on a difference between the tank pressure and the ambient air pressure.

The CM 110 performs a fuel system diagnostic on the fuel system 100. For example, the CM 110 may perform the diagnostic to detect leaks in the fuel system 100. If the diagnostic is performed when the vehicle is on or immediately after vehicle shutdown, results of the diagnostic may be inconsistent and/or inaccurate. The CM 110 according to the present disclosure performs the diagnostic on the fuel system 100 when the vehicle is off (e.g. keyed off) for a predetermined period. More specifically, the CM 110 is powered off and/or transitioned to a low power sleep mode when the engine is turned off. The CM 110 is awakened after a wakeup period to perform the diagnostic.

Figure 2:
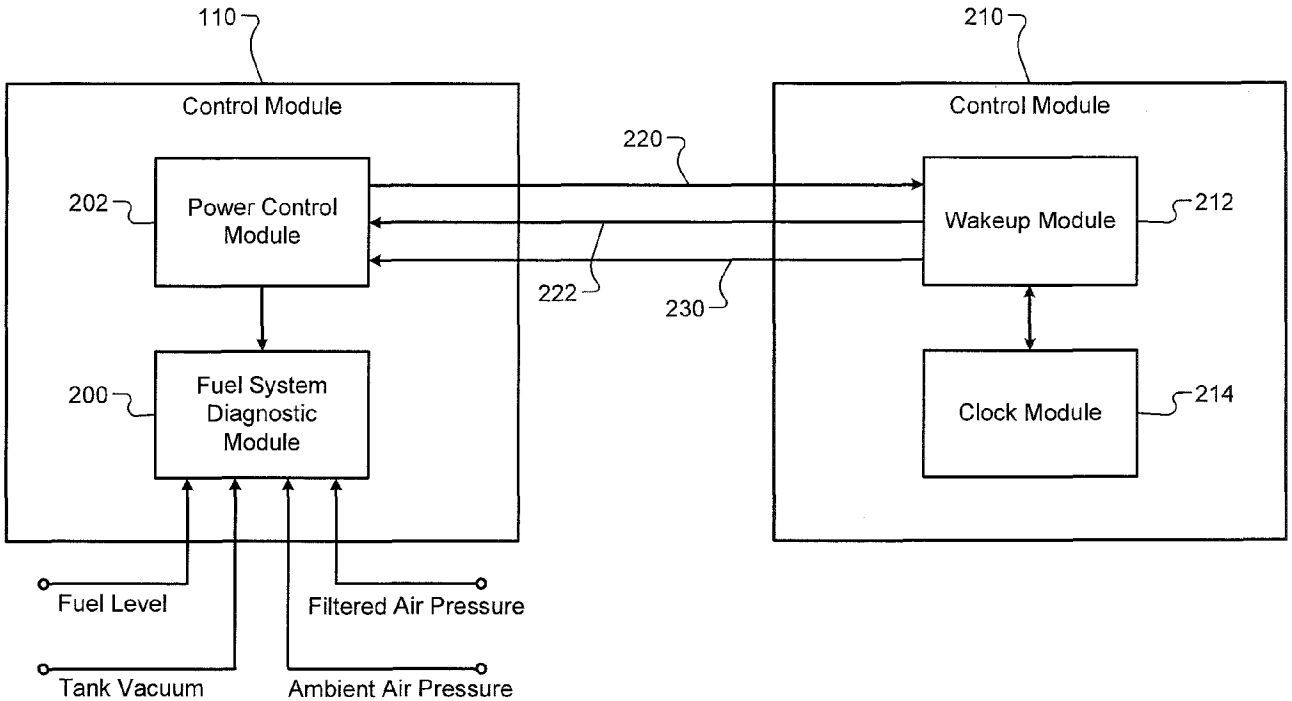
FIG. 2 is a functional block diagram of first and second control modules according to the principles of the present disclosure.

Referring now to FIG. 2, the CM 110 includes a fuel system diagnostic module 200 and a power control module 202. The fuel system diagnostic module 200 performs the diagnostic on the fuel system 100 based on one or more measured variables of the fuel system 100, including, but not limited to, the fuel level, the tank vacuum, the ambient air pressure, and the filtered air pressure.

The power control module 202 communicates with a second control module (CM) 210. The CM 110 and the second CM 210 are independent control modules. For example, the CM 110 and the second CM 210 may be located in different integrated circuits (ICs), on different printed circuit boards (PCBs), and/or arranged in different locations within the vehicle. For example only, the second control module 210 may be a vehicle integration control module (VICM), a body control module, or any other suitable vehicle control module.

The power control module 202 turns off the CM 110 when the engine is turned off and determines whether a wakeup of the CM 110 is needed. For example, the fuel system diagnostic module 200 may perform the diagnostic periodically (e.g. based on a predetermined period since a previous diagnostic) and/or after the vehicle has driven a predetermined number of miles. The power control module 202 determines that the wakeup of the CM 110 is needed if the predetermined period has passed since the previous diagnostic and/or the vehicle has driven the predetermined number of miles.

After the wakeup period, the second control module 210 communicates with the power control module 202 to turn on (i.e. wake up) the CM 110, or to wake up only the fuel system diagnostic module 200. Once awake, the fuel system diagnostic module 200 performs the diagnostic.

The second CM 210 includes a wakeup module 212 and a clock module 214. When the vehicle is keyed off, the power control module 202 determines whether a wakeup of the CM 110 is desired. If the wakeup is desired, the power control module 202 transmits a wakeup request 220 to the second CM 210 (e.g. the wakeup request 220 is in a "set" state). For example, the wakeup request 220 may include the wakeup time to wait before waking up the CM 110. If the wakeup is not desired, the wakeup request 220 may indicate that no wakeup action is to be taken (e.g. the wakeup request 220 is in a "no action" state).

The wakeup module 212 transmits the wakeup time to the clock module 214 (e.g. to initialize the clock module 214 with the wakeup time) and transmits a wakeup status 222 to the power control module 202. The wakeup status 222 indicates that the second CM 210 received the wakeup request 220 and initialized the clock module 214. For example, the wakeup status 222 may include active and inactive states. The wakeup status 222 transitions from the inactive state to the active state when the clock module 214 is initialized. The power control module 202 turns off the CM 110 after the wakeup status 222 transitions to the active state.

The clock module 214 determines when to wake up the CM 110 based on the wakeup time. For example, the clock module 214 may begin incrementing a timer in response to receiving the wakeup time from the wakeup module 212, or when the power control module 202 turns off the CM 110. When the timer reaches the wakeup time, the wakeup module 212 transmits a wakeup signal 230 to the power control module 202. For example, the wakeup module 212 may transmit the wakeup signal 230 via an accessory line connected between the second CM 210 and the CM 110.

Once awake, the power control module 202 may determine whether the wakeup signal 230 was received from the second CM 210 and/or whether the wakeup signal 230 was received at the proper time. For example, if the wakeup status 222 status is still in the active state, then the power control module 202 determines that the wakeup module 212 did not wake up the power control module 202. Conversely, if the wakeup status 222 is in an expired state, then the wakeup status 222 indicates that the wakeup time expired and therefore the wakeup module 212 awakened the power control module 202.

The power control module 202 may determine whether the wakeup signal 230 was received according to the wakeup time transmitted via the wakeup request 220. The CM 110 may store a vehicle key off time and determine whether a current time indicates that the wakeup signal was received within predetermined range of the wakeup time (i.e. that current time−key off time=wakeup time). The power control module 202 may determine that the second CM 210 (e.g. the wakeup module 212 and/or the clock module 214) is faulty if the wakeup signal 230 was not received according to the wakeup time. Consequently, the power control module 202 may transmit the wakeup request 220 to another module after subsequent vehicle shutoffs.

Upon receiving the wakeup signal 230, the power control module 202 instructs the fuel system diagnostic module 200 to perform the diagnostic, and retransmits the wakeup request 220 (e.g. the wakeup request 220 transitions to the "set" state). Accordingly, if the diagnostic is interrupted and is not completed for any reason, the wakeup module 212 will awaken the power control module 202 again after waiting another wakeup time. If the fuel system diagnostic module 200 completes the diagnostic, the power control module 202 cancels the wakeup request 220 (e.g. the wakeup request 220 transitions to a "cancel" state).

Figure 3:
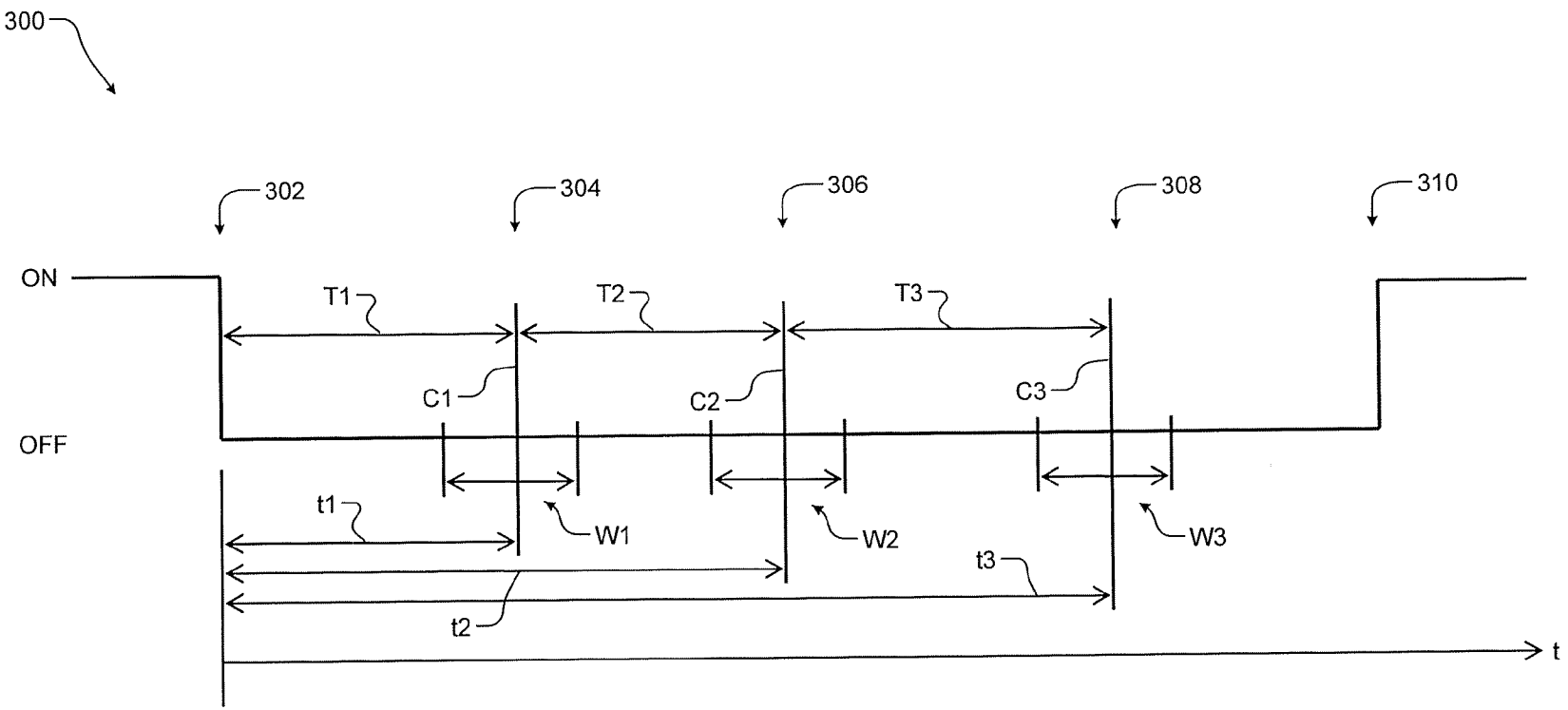
FIG. 3 is a timing diagram illustrating timing of communication between the first and second modules according to the principles of the present disclosure.

Referring now to FIG. 3, a timing diagram 300 illustrates timing of communication between the CM 110 and the second CM 210. The vehicle (e.g. a propulsion system of the vehicle) transitions from an ON state to an OFF state and the power control module 202 transmits a first wakeup request that includes a calibrated wakeup time T1 at 302. The calibrated wakeup time T1 is based on a difference between a current time and a predetermined time C1. The CM 110 wakes up in response to, for example, a wakeup signal from the second CM 210. The second CM 210 feeds back the wakeup signal based on the time T1 (e.g. a timer based on predetermined C1 and a time t1 since key off). If the CM 110 wakes up within a wakeup window W1 at 304 (e.g. within a range of the wakeup time C1), the CM 110 transmits a second wakeup request that includes a wakeup time T2 and performs the fuel system diagnostic (e.g. with the fuel system diagnostic module 200). The time T2 is based on a difference between a current time and a predetermined time C2.

If the CM 110 completes the fuel diagnostic, the CM 110 attempts to cancel the second wakeup request. If the CM 110 does not complete the diagnostic, the CM 110 returns to the sleep mode and waits for a second wakeup signal to rerun the diagnostic. The second CM 210 feeds back the wakeup signal based on the time T2 (e.g. a timer based on a predetermined time C2 and a time t2 since key off). If the CM 110 wakes up within a wakeup window W2 at 306 (e.g. within a range of the wakeup time C2), the CM 110 transmits a third wakeup request that includes a wakeup time T3 and performs the fuel system diagnostic if the CM 110 did not complete the fuel system diagnostic during the previous wakeup. The time T3 is based on a difference between a current time and a predetermined time T3. If the CM 110 completes the fuel system diagnostic, the CM 110 attempts to cancel the third wakeup request. If the CM 110 does not complete the fuel system diagnostic, the CM 110 returns to the sleep mode and waits for a third wakeup signal to rerun the diagnostic.

The second CM 210 feeds back the wakeup signal based on the time T3 (e.g. a timer based on a predetermined time C3 and a time t3 since key off). If the CM 110 wakes up within a wakeup window W3 at 308 (e.g. within a range of the wakeup time C3), the CM 110 again attempts to request another wakeup and perform the fuel system diagnostic. The CM 110 may attempt to request additional wakeups and complete the fuel system diagnostic multiple times until either the fuel system diagnostic is completed and/or the vehicle transitions to the ON state at 310. The wakeup test and the fuel system diagnostic will abort if a wakeup diagnostic fails before the vehicle transitions to the ON state at 310. The wakeup test will cancel the wakeup if the wakeup diagnostic fails.

Figure 4:
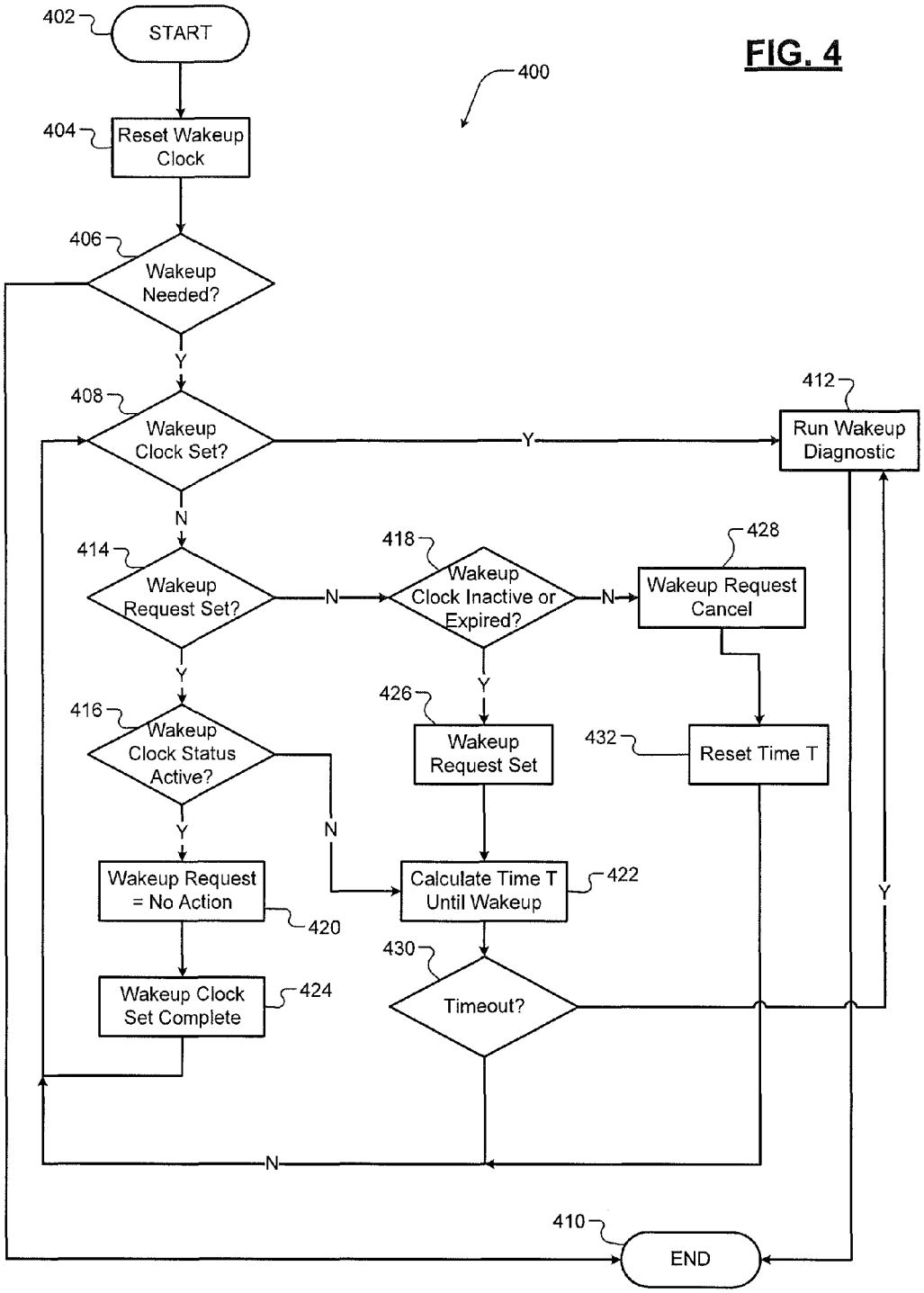
FIG. 4 is a flow diagram illustrating steps of a wakeup control method according to the principles of the present disclosure.

Referring now to FIG. 4, a wakeup control method 400 begins in step 402. In step 404, the method 400 resets a wakeup clock. For example, the clock module 214 may reset the wakeup clock (e.g. the clock status and timer). In step 406, the method 400 determines whether a wakeup is needed. For example, the CM 110 determines whether the wakeup is needed. If true, the method 400 continues to step 408. If false, the method 400 ends in step 410.

In step 408, the method 400 determines whether the wakeup clock is set (i.e. setting of the wakeup clock is complete). For example, the method 400 determines whether a wakeup clock set status is in a "complete" state. If true, the method 400 continues to step 412. If false, the method 400 continues to step 414. In step 412, the method 400 performs a wakeup diagnostic and then ends in step 410. For example, the CM 110 may perform the wakeup diagnostic as described below in FIG. 5.

In step 414, the method 400 determines whether a wakeup request was made by the CM 110. For example, the method 400 determines whether the wakeup request 220 is in the "set" state. If true, the method 400 continues to step 416. If false, the method 400 continues to step 418. In step 416, the method 400 determines whether the wakeup clock status 222 is active. For example, the method 400 determines whether the wakeup status 222 is in an "active" state. If true, the method 400 continues to step 420. If false, the method 400 continues to step 422. In step 420, the method 400 transitions the wakeup request 220 to the "no action" state. In step 424 the method 400 transitions the wakeup clock set status to the "complete" state and continues to step 408.

In step 418, the method 400 determines whether the wakeup clock is inactive or expired. For example, the method 400 determines whether the wakeup status 222 is in the "inactive" or "expired" state. If true, the method 400 continues to step 426. If false, the method 400 continues to step 428. In step 426, the method 400 transitions the wakeup request 220 to the "set" state and continues to step 422. In step 422, the method 400 calculates a time T to wakeup. For example, the second CM 210 may calculate the time T as described below in FIG. 6. In step 430, the method 400 determines whether the wakeup clock set status is in a "time out" state. For example, the "time out" state may indicate that a current time is already within a proper wakeup window (e.g. the window W1 as shown in FIG. 3). If true, the method 400 continues to step 412. If false, the method 400 continues to step 408.

In step 428, the method 400 transitions the wakeup request 220 to the "cancel" state. In step 432, the method 400 resets the time T to zero.

Figure 5:
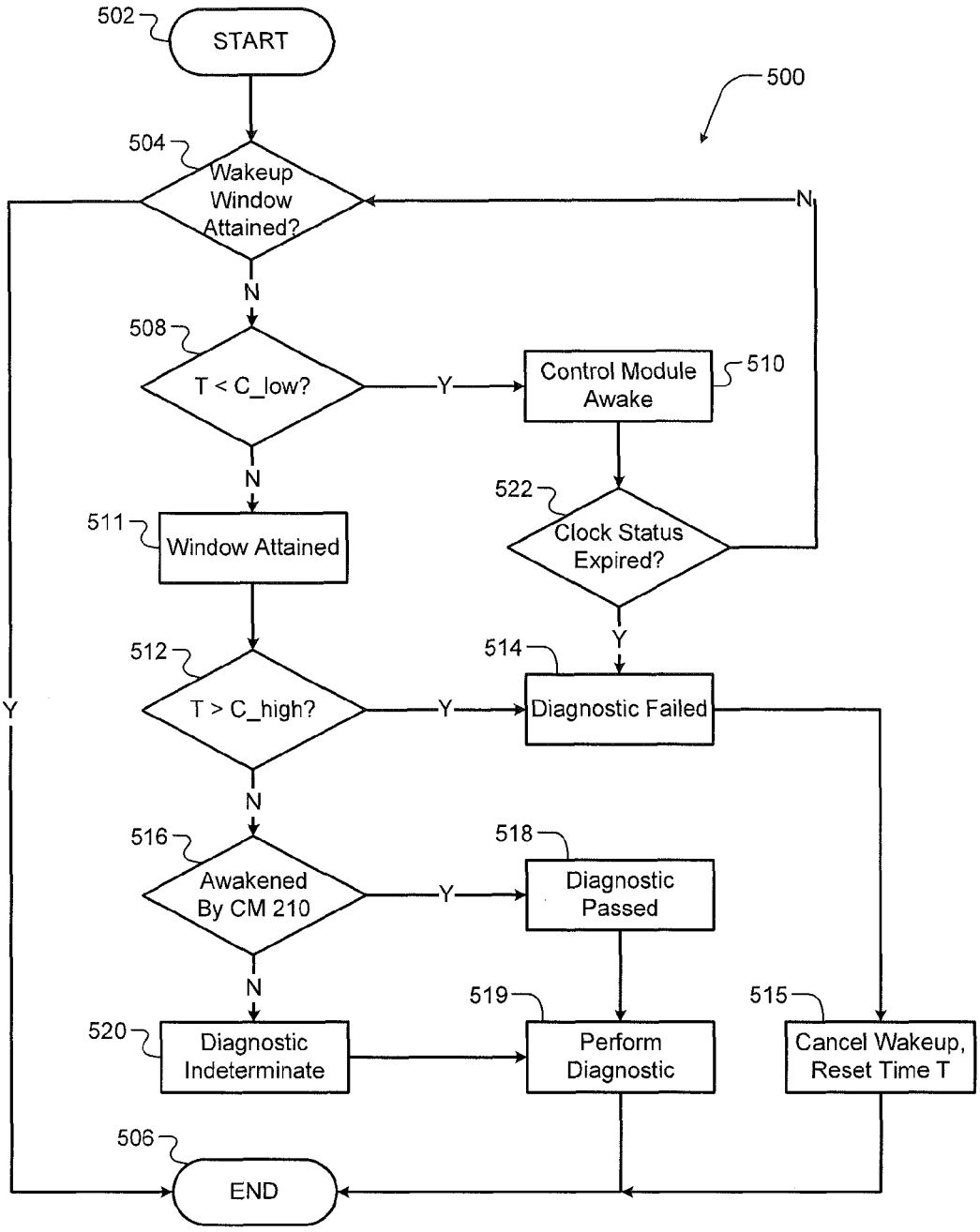
FIG. 5 is a flow diagram illustrating steps of a wakeup diagnostic method according to the principles of the present disclosure.

Referring now to FIG. 5, a wakeup diagnostic method 500 begins in step 502. In step 504, the method 500 determines whether a wakeup window is attained. For example, the method 500 determines whether the CM 110 was awakened within the window W1. If true, the method 500 ends (i.e. returns to the method 400 shown in FIG. 4) in step 506. If false, the method 500 continues to step 508. In step 508, the method 500 determines whether a time t (e.g. a time t since key off) is less than a low threshold C1_low for the window W1 corresponding to a calibrated wakeup time C1 (e.g. whether t<C1_low). If true, the method 500 continues to step 510. If false, the method 500 continues to step 511. In step 511, the method 500 determines that the wakeup window is attained.

In step 512, the method 500 determines whether the time t is greater than a high threshold C1_high for the window W1 corresponding to the calibrated wakeup time C1 (e.g. whether t>C1_high). If true, the method 500 continues to step 514. If false, the method 500 continues to step 516. In step 514, the method 500 determines that the wakeup diagnostic failed. In step 516, the method 500 determines whether the CM 110 is awakened by the CM 210. If true, the method 500 continues to step 518. If false, the method 500 continues to step 520. In step 518, the method 500 determines that the wakeup diagnostic passed and continues to step 519. In step 520, the method 500 determines that a result of the wakeup diagnostic is indeterminate and continues to step 519. In step 519, the method 500 initiates the fuel system diagnostic.

In step 510, the method 500 sets a status of the CM 110 to awake. In step 522, the method 500 determines whether the wakeup status 222 is "expired." If true, the method 500 continues to step 514. If false, the method 500 continues to step 504. In step 514, the method 500 determines that the wakeup diagnostic failed and continues to step 515. In step 515, the method 500 cancels the wakeup request and resets T to zero.

Figure 6:
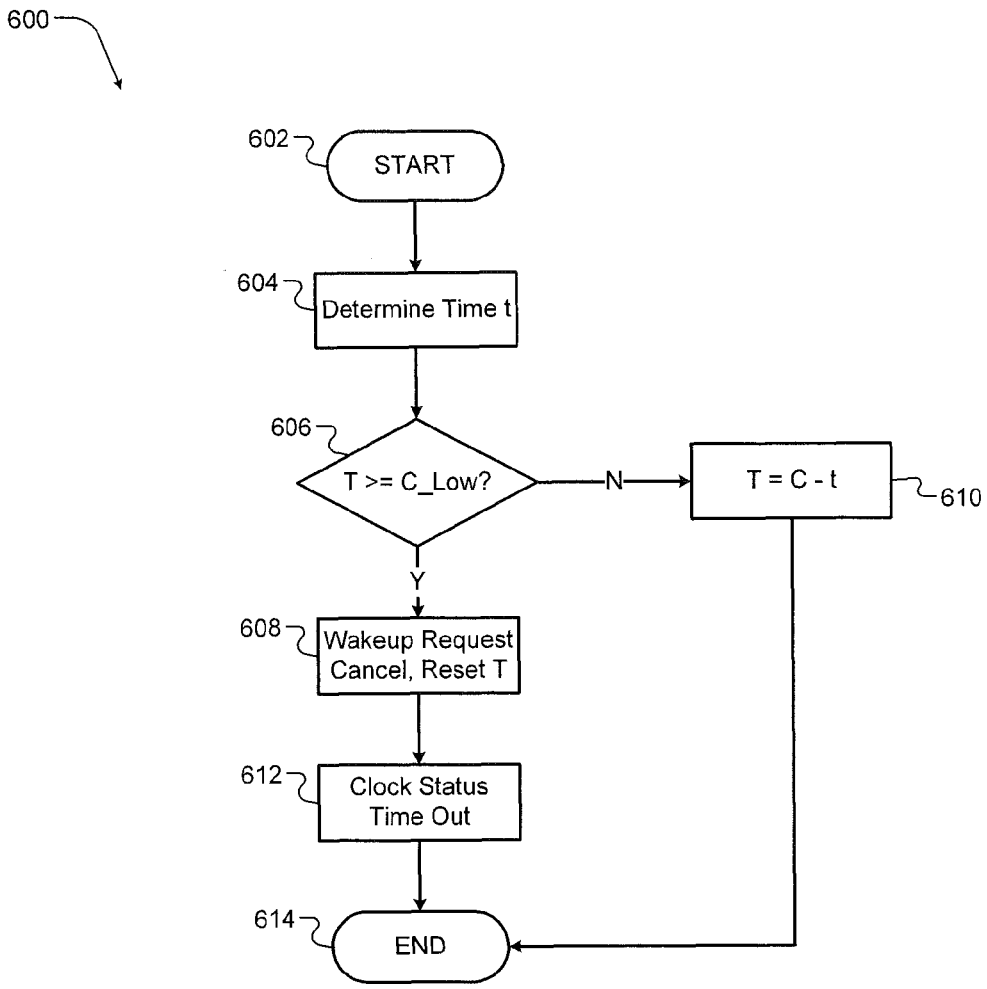
FIG. 6 is a flow diagram illustrating steps of a wakeup time calculation method according to the principles of the present disclosure.

Referring now to FIG. 6, a wakeup time calculation method 600 begins in step 602. In step 604, the method 600 determines the time t since key off. In step 606, the method 600 determines whether the time t is greater than or equal to the calibrated wakeup time C_low. If true, the method 600 continues to step 608. If false, the method 600 continues to step 610. In step 608, the method 600 sets the wakeup request 220 to the "cancel" state and resets the time T to zero. In step 612, the method 600 sets wakeup clock set status to "time out" and ends (e.g. returns to the method 400) in step 614. In step 610, the method 600 sets the time T as a difference between the calibrated wakeup time C and the time t since key off (e.g. T=C−t).

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel system diagnostic wakeup system for a vehicle, the system comprising:

a first control module that:

generates a wakeup request; and powers off when the vehicle powers off; and a second control module, independent of the first control module, that receives the wakeup request and generates a wakeup signal to wake up the first control module after the vehicle powers off i) based on the wakeup request and ii) in response to a predetermined period, associated with the wakeup request, expiring, wherein the first control module powers on and performs, while the vehicle is powered off and in response to the wakeup signal, a fuel system diagnostic.

2. The system of claim 1 wherein first control module determines whether the fuel system diagnostic is necessary prior to generating the wakeup request.

3. The system of claim 1 wherein the wakeup request defines the predetermined period, and wherein the predetermined period is based on at least one of a predetermined wakeup time and a time passed since the vehicle powered off.

4. The system of claim 1 wherein the first control module generates a second wakeup request in response to the wakeup signal.

5. The system of claim 4 wherein the first control module cancels the second wakeup request when the fuel system diagnostic is complete.

6. The system of claim 4 wherein the second control module generates a second wakeup signal based on the second wakeup request.

7. The system of claim 1 wherein the first control module performs a wakeup diagnostic in response to the wakeup signal.

8. The system of claim 1 wherein the first control module is an engine control module.

9. The system of claim 1 wherein the first control module is located in a first integrated circuit and the second control module is located in a second integrated circuit.

10. A fuel system diagnostic wakeup method for a vehicle, the method comprising:

generating a wakeup request using a first control module;

powering off the first control module when the vehicle powers off;

receiving the wakeup request at a second control module independent of the first control module;

at the second control module, generating a wakeup signal to wake up the first control module after the vehicle powers off i) based on the wakeup request and ii) in response to a predetermined period, associated with the wakeup request, expiring; and while the vehicle is powered off, powering on the first control module and performing a fuel system diagnostic with the first control module in response to the wakeup signal.

11. The method of claim 10 further comprising determining whether the fuel system diagnostic is necessary prior to generating the wakeup request using the first control module.

12. The method of claim 10 wherein the wakeup request defines the predetermined period, and wherein the predetermined period is based on at least one of a predetermined wakeup time and a time passed since the vehicle powered off.

13. The method of claim 10 further comprising generating a second wakeup request in response to the wakeup signal using the first control module.

14. The method of claim 13 further comprising cancelling the second wakeup request when the fuel system diagnostic is complete.

15. The method of claim 13 further comprising generating a second wakeup signal based on the second wakeup request using the second control module.

16. The method of claim 10 further comprising performing a wakeup diagnostic in response to the wakeup signal at the first control module.

17. The system of claim 10 wherein the first control module is an engine control module.

18. The method of claim 10 further comprising locating the first control module in a first integrated circuit and locating the second control module in a second integrated circuit.

* * * * *